US005099106A

United States Patent [19]

Biancone

[11] Patent Number: 5,099,106

[45] Date of Patent: Mar. 24, 1992

[54] PARCEL SEALING DEVICE USING THERMOLABILE ADHESIVE TAPE

[76] Inventor: Patrizia Biancone, Via di Frascati, 264, Rocca di Papa, Italy, I-00040

[21] Appl. No.: 286,951

[22] PCT Filed: Mar. 18, 1988

[86] PCT No.: PCT/IT88/00018

§ 371 Date: Jan. 17, 1989

§ 102(e) Date: Jan. 17, 1989

[87] PCT Pub. No.: WO88/06977

PCT Pub. Date: Sep. 22, 1988

[30] Foreign Application Priority Data

Mar. 20, 1987 [IT] Italy ..... 47756 A/87

[51] Int. Cl.[5] ..... H05B 1/02; H05B 3/00; B43M 1/00; G09F 3/04

[52] U.S. Cl. ..... 219/228; 101/8; 101/9; 101/27; 101/31; 156/579; 156/583.1; 156/DIG. 36; 156/DIG. 51; 219/241; 219/243; 425/386; 425/445

[58] Field of Search ..... 156/DIG. 21, DIG. 36, 156/DIG. 51, 579, 583.1; 219/221, 227-230, 240-243; 101/31, 27, 25, 8, 9; 425/445, 386

[56] References Cited

U.S. PATENT DOCUMENTS

| | | | |
|---|---|---|---|
| 1,157,687 | 10/1915 | Garner et al. | 219/227 |
| 1,385,749 | 7/1921 | Mueller | 425/445 |
| 1,716,937 | 6/1929 | Whited | 101/27 X |
| 1,960,776 | 5/1934 | Flothow | 219/227 |
| 2,585,504 | 2/1952 | Severance | 219/227 X |
| 3,584,190 | 6/1971 | Marcoux | 219/241 X |

FOREIGN PATENT DOCUMENTS

| | | | |
|---|---|---|---|
| 697412 | 10/1930 | France | 219/227 |
| 1054735 | 10/1953 | France | 219/228 |
| 8003795 | 2/1982 | Netherlands | 219/228 |

*Primary Examiner*—Anthony Bartis

*Attorney, Agent, or Firm*—Andrus, Sceales, Starke & Sawall

[57] ABSTRACT

A device for sealing folders, parcels, and the like. The device comprises a handle which carries at its free end a metal plate containing an image to be printed, a thermoelectric element for heating the plate, and a heat accumulator for maintaining the temperature of the plate. An adhesive thermolabile tape comprises a semi-transparent film of cellulose acetate carrying on one of its faces a layer of colored adhesive material. The film is "scorched" by the action of the seal so as to display in an indelible way, the image of the latter.

13 Claims, 2 Drawing Sheets

PARCEL SEALING DEVICE USING THERMOLABILE ADHESIVE TAPE

DESCRIPTION

The object of the present invention is a device for thermosealing folders, parcels and the like. As is well known, the conventional sealing of folders, or parcels has experienced during the years several changes. From conventional sealing wax and lead seals, a wide variety of seals have been adopted, the form and the way of application of the seals being different depending on the use, the importance and the dimensions of the object to be protected, Nowadays it can be said that nearly universally adhesive tapes are employed which are completed by dry stamps which can be dry or soaked with indelible ink. In any case however, besides the required practicability and rapidity of this kind of operations, there does not yet exist an absolute certainty that the objects to be protected are free from tampering or illicit handling.

The purpose of this invention is to provide a sealing device which in addition to the easiness and practicability of use ensures an absolute certainty of the completeness of the outer cover or of the objects which are so treated. Such purpose, according to the invention, is obtained by means of an image seal hot-applied on an adhesive thermolabile tape whereby, at completion, the image of said seal printed in relief can be obtained on the surface of said tape, and the corresponding image indelibly "scorched" on the applied surface of the tape, so as to form a single body and to immediately reveal any tampering of the tape itself, when the latter is removed in a fraudulent way.

According to the invention a sealing device is provided which comprises a metal plate on which the image of the seal is reproduced, which plate is mounted at the free end of a handle and is telescopically slidable within a cylindrical tube, a thermistor intended for heating said seal-plate when switched on; means for maintaining the temperature of said plate at a substantially constant and predetermined level and an adhesive tape intended for cooperating with said seal, which tape comprises a cellulose acetate semitransparent film and a layer of colored adhesive material which is applied on that of the tape faces which is to be spread out in contact with the envelope to be protected; the colored adhesive material being intended for being "scorched" as a consequence of the action of said seal and become a single body with the envelope material, the image of said seal being indelibly reprinted on the latter.

The invention will be now described with reference to the annexed drawings which show, as an example, and not a limitation a preferred embodiment of the invention.

Figure 1:
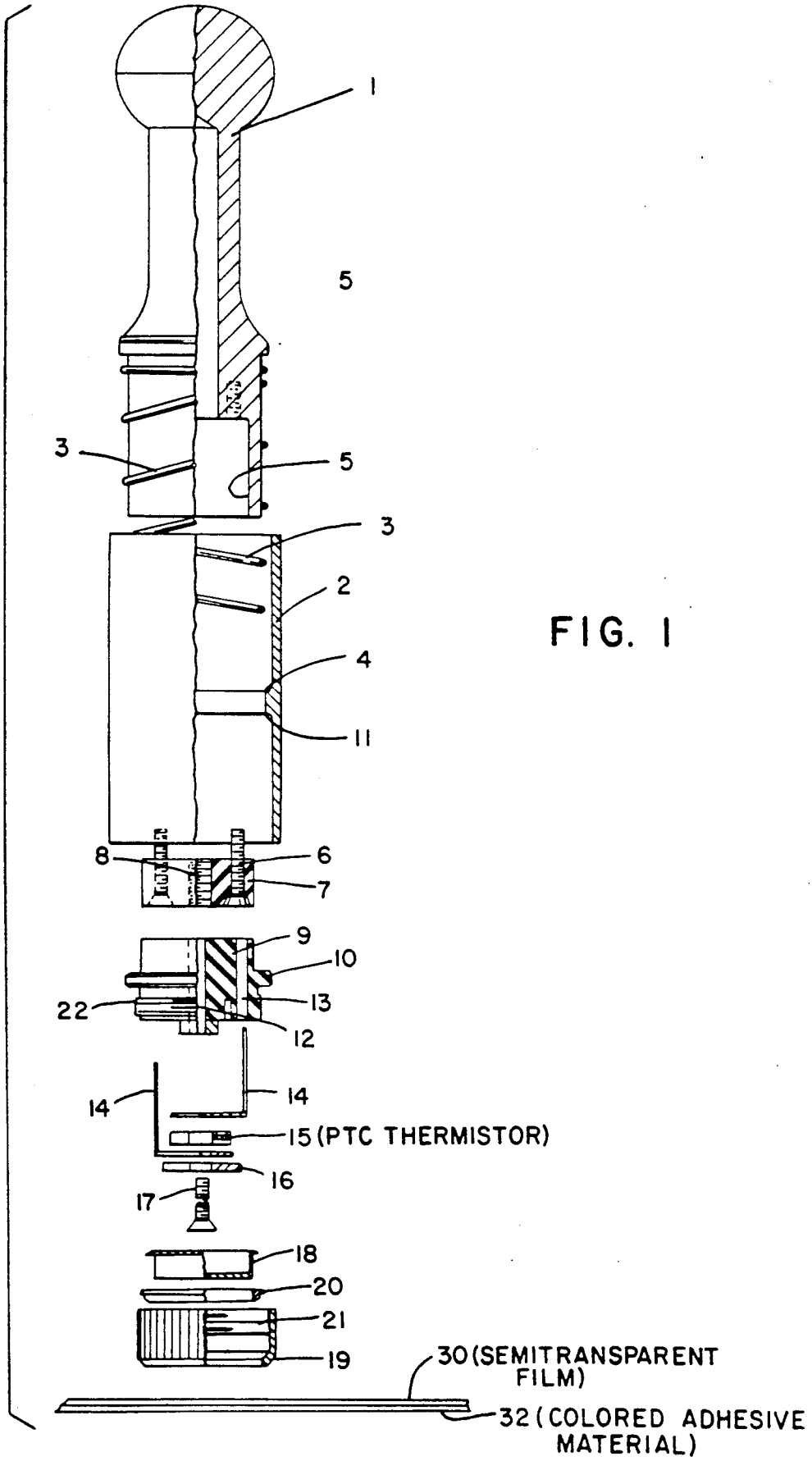
FIG. 1 shows an exploded veiw of the device partially sectioned along an axial plane.
Figure 2:
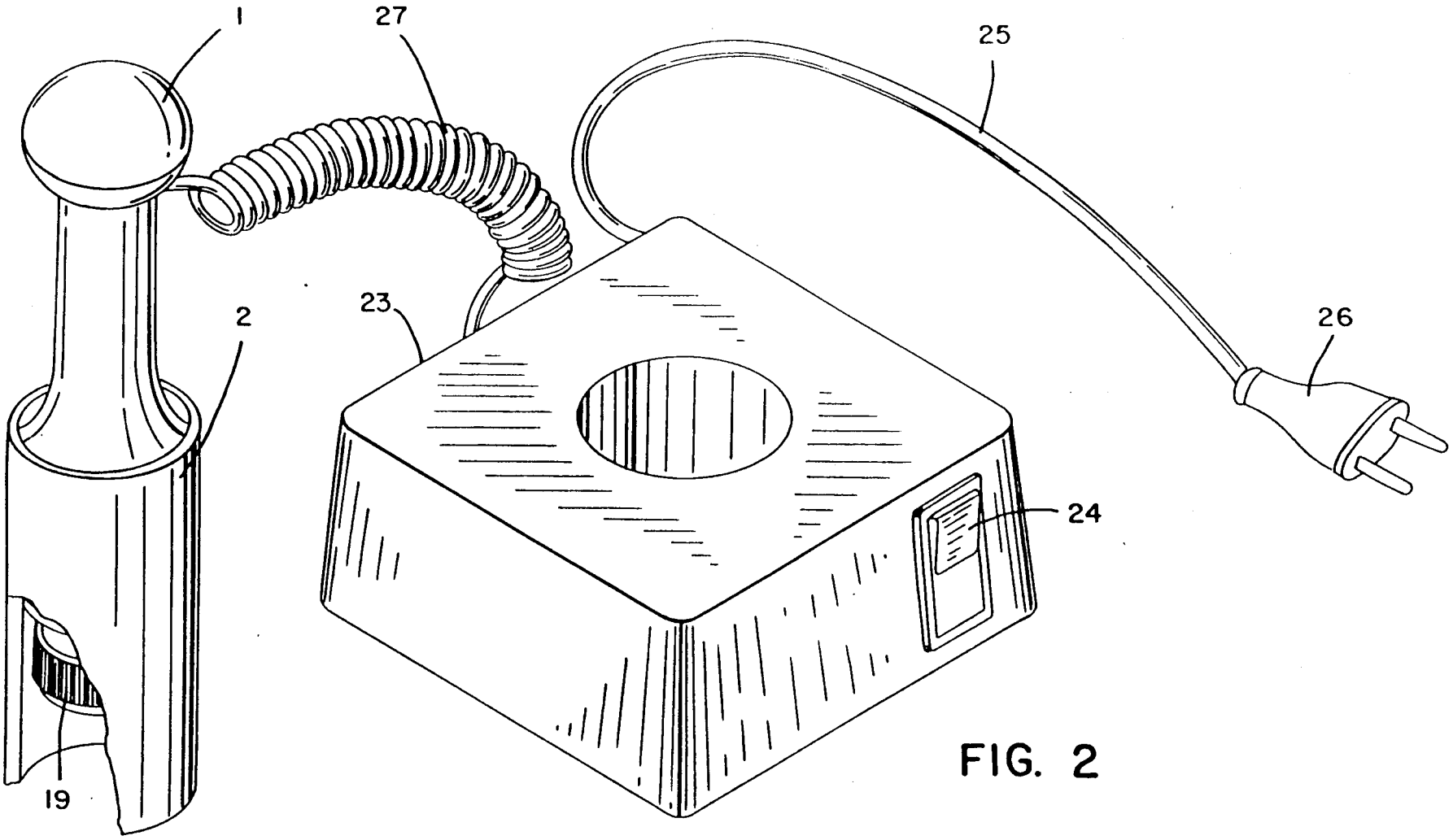
FIG. 2 shows a thermo-seal with the related stand and its supply cable.

With reference to FIG. 1, reference numeral 1 indicates the handle which is telescopically slidable within a sleeve means comprising a tube 2 against an opposing spring 3 mounted between these two elements, (handle and tube) and resting on shoulder 4 as shown in FIG. 2, tube 2 serves to shield heated portions of the device and as a stand for the device. A cylindrical space 5 is defined within handle 1, a block 7 being housed within space 5 by means of a pair of screws 6, which block is provided with a central bore 8. Under block 7 head 9 is located which is provided with a collar 10 that abuts against shoulder 11 of tube 2 and three through-holes one of which, indicated by 12, is center aligned with bore 8 and two other bores 13 through which tabs 14 pass. Tabs 14 comprise the electrodes connected with a supply cable 27 provided to handle 1 in the manner shown in FIG. 2 and extending through the handle to tabs 14.

Between electrodes 14 a PTC thermistor 15, namely a resistor, is located which, after reaching a predetermined temperature, automatically cuts off the power for the purpose of preventing any overheating.

A metal disk 16 is mounted in contact and between the described elements, the purpose of which is to act as a thermal stabilizer or heat accumulator as it will be better explained in the following. All the above elements are attached to block 7 by means of screw 17 which fits into the center bore 8 of block 7 after passing through hole 12 and corresponding holes in heat accumulator 16 and thermistor 15.

A plate 18 on which the seal is provided is in contact with the heat accumulator 16. Plate 18, in turn, is fitted in a knurled nut 19 with the interposition of a sealing ring 20. Plate 18 extends beyond knurled nut 19, as shown in FIG. 2. Knurled nut 19 in turn has an inner thread 21 which screws on the outer thread 22 of head 9.

From the preceding passage it is evident that by unscrewing nut 19 it is possible to readily exchange seal 18 and to disassemble the whole fixture.

The device up to now described is intended for being employed in cooperation with a particular type of adhesive tape consisting of a cellulose acetate semitransparent film 30 having the shape of a tape which carries on one of its faces a layer of adhesive material 32 having a colored pigment and having particular characteristics of thermolability correlated with the rated temperature predetermined of the seal.

The device operation is as follows: plate-seal 18 is heated by means of thermistor 15 up to the predetermined temperature at which the circuit is shut off by the same thermistor. Heat accumulator 16 which during the initial step has been heated, transmits heat to seal 18 whenever the latter would become cold due to the supply cutoff whereby as a practical matter the seal maintains a thermal level which is substantially constant.

The above described adhesive tape is applied on the object to be sealed, and thereafter at the proper points of the envelope the warm seal is impressed the same way as a usual stamp. The seal image is impressed on the outer face of the tape (the same way as by a usual dry stamp) and the colored adhesive layer, which is "scorched" by the seal, reproduces on the object to the sealed the image itself. This colored imprint is indelible even if the transparent layer is subsequently removed. From the above clearly appears the absolute certainty of freedom from tampering.

The apparatus, as a whole, can have the shape shown in FIG. 2. A block stand 23 can be provided which in its form and dimensions imitates the conventional pad but it is provided with a control switch 24 and with a possible warning lamp, for the apparatus operation. From block 23 a supply cable 25 issues which is provided with a plug 26 and a connecting cable 27.

The present invention has been illustrated and described in a preferred embodiment thereof; however it is clear that a number of structural changes can be practically introduced in it without departing from the scope of the present invention.

I claim:

1. A device for creating a seal in a thermolabile adhesive tape appliable to an object or to a container therefor, said device comprising:

a metal plate with a surface having an engraved or raised design of the seal desired to be created on the tape;

means for heating said metal plate to a predetermined temperature;

heat accumulator means interposed between, and abutting, said heating means and said metal plate for maintaining the metal plate at the predetermined temperature;

an elongated handle, one end of which is suitable for being grasped by hand, said heating means and said heat accumulator means being mounted in abutment with each other adjacent the other end of said handle;

a knurled nut surrounding the periphery of said metal plate removably mounting said metal plate to the other end of said handle in abutment with said heat accumulator means and with said surface containing said design exposed; and sleeve means open at both ends surrounding said handle, said handle being supported by and mounted for telescopic movement solely within said sleeve means between a retracted position in which said metal plate is retracted within said sleeve means and said device can be supported on said sleeve means in spaced relation to a tape to be heated, and a working position in which said metal plate may contact the tape for pressing the heated metal plate onto the tape to create the seal.

2. The device according to claim 1 wherein said heating means comprises a PTC thermistor.

3. The device according to claim 1 wherein said heat accumulator means comprises a further metal plate.

4. The device according to claim 1 wherein said handle has means interposed between said heating means and said handle for mounting said heating means and said heat accumulator means to said handle, and wherein said knurled nut is threadable on said mounting means for retaining said metal plate on the handle.

5. The device according to claim 1 further including means for biasing the handle to the retracted position.

6. The device according to claim 5 further including means on said handle and sleeve means for establishing the position of said handle within said sleeve means in the retracted position.

7. In a system for creating a seal on an object or a container therefor, said system comprising a thermolabile tape comprising a thermally distortable carrier film, and a colored adhesive material carried by said film, said adhesive material being meltable at a given temperature, said tape being appliable to the object or container on which the seal is to be placed with the adhesive material abutting the object or container, said seal being created by contacting the tape with a thermosealing device, the improvement wherein said thermo-sealing device comprises:

a metal plate with a surface having an engraved or raised design of the seal desired to the created on the tape;

means for heating said metal plate to the melting temperature of said adhesive material;

heat accumulator means interposed between, and abutting, said heating means and said metal plate for maintaining the metal plate at the melting temperature;

an elongated handle, one end of which is suitable for being grasped by hand, said heating means and said heat accumulator means being mounted in abutment with each other adjacent the other end of said handle;

a knurled nut surrounding the periphery of said metal plate removably mounting said metal plate to the other end of said handle in abutment with said heat accumulator means and with said surface containing said design exposed; and sleeve means open at both ends surrounding said handle, said handle being supported by and mounted for telescopic movement solely within said sleeve means between a retracted position in which said metal plate is retracted within said sleeve means and a working position in which said metal plate may contact the tape for pressing the heated metal plate onto the tape to create the seal, whereby the pressing of the heated metal plate on the tape distorts the carrier film to form a seal and melts the adhesive material to print an image of the seal on the object or container.

8. In the system according to claim 7 wherein said carrier film comprises a cellulose acetate transparent film.

9. In a system according to claim 7 wherein said heating means comprises a PTC thermistor.

10. In a system according to claim 7 wherein said heat accumulator means comprises a further metal plate.

11. In a system according to claim 7 wherein said handle has means interposed between said heating means and said handle for mounting said heating means and said heat accumulator means to said handle, and wherein said knurled nut is threadable on said mounting means for retaining said metal plate on the handle.

12. In a system according to claim 7 further including means for biasing the handle to the retracted position.

13. In a system according to claim 12 further including means on said handle and sleeve means for establishing the position of said handle within said sleeve means in the retracted position.

* * * * *